US006829861B1

(12) United States Patent
Kobrehel et al.

(10) Patent No.: US 6,829,861 B1
(45) Date of Patent: Dec. 14, 2004

(54) AWNING-TYPE INSULATED GLAZING ASSEMBLY

(75) Inventors: Michael D. Kobrehel, Elkhart, IN (US); Todd E. Cripe, Goshen, IN (US); Darren M. Grumm, Cassopolis, MI (US); Natvar H. Soni, Middlebury, IN (US); Daryl F. Dankert, Mishawaka, IN (US); LeRoy C. Schmuck, Kendallville, IN (US)

(73) Assignee: Atwood Mobile Products, Inc., Elkhart, IN (US)

( * ) Notice: Subject to any disclaimer, the term of this patent is extended or adjusted under 35 U.S.C. 154(b) by 0 days.

(21) Appl. No.: 10/219,986

(22) Filed: Aug. 15, 2002

(51) Int. Cl.[7] ..... E05F 9/00; E05F 11/24

(52) U.S. Cl. ..... 49/356; 49/346; 49/397; 49/324; 16/355

(58) Field of Search ..... 49/356, 345, 346, 49/381, 397, 402, 324, 339, 341, 344, 342, 260, 261; 16/355, 267, 225, DIG. 13, 266; 160/371; 52/204.62, 204.69

(56) References Cited

U.S. PATENT DOCUMENTS

| | | | | | |
|---|---|---|---|---|---|
| 2,977,810 | A | * | 4/1961 | Stavenau | 49/345 |
| 3,214,157 | A | * | 10/1965 | Stavenau | 49/324 |
| 3,457,675 | A | * | 7/1969 | Armstrong | 49/356 |
| 3,461,609 | A | * | 8/1969 | Armstrong | 49/324 |
| 4,104,825 | A | * | 8/1978 | Hosmer | 49/324 |
| 4,132,035 | A | * | 1/1979 | Frambach | 49/381 |
| 4,617,758 | A | * | 10/1986 | Vetter | 49/324 |
| 5,103,590 | A | * | 4/1992 | Hanemaayer | 49/324 |
| 5,339,568 | A | * | 8/1994 | Hanemaayer | 49/324 |
| 5,551,197 | A | | 9/1996 | Repp et al. | 52/204.62 |
| 6,145,165 | A | * | 11/2000 | Torcato | 49/397 |
| 6,164,715 | A | | 12/2000 | Mosaner | 296/146.1 |
| 6,312,043 | B1 | | 11/2001 | Blackburn et al. | 296/146.16 |
| 6,412,225 | B1 | | 7/2002 | McManus | 49/381 |

FOREIGN PATENT DOCUMENTS

| | | |
|---|---|---|
| CA | 1057796 | 7/1979 |

* cited by examiner

*Primary Examiner*—Hugh B. Thompson, II
(74) *Attorney, Agent, or Firm*—Peter D. McDermott; Dean B. Watson; Banner & Witcoff, Ltd.

(57) ABSTRACT

An awning-type insulated glazing assembly includes an insulated glazing having a first glazing pane and a second glazing pane mounted parallel to and spaced from the first glazing pane. The first glazing pane has a marginal portion extending beyond the second glazing pane in at least a first direction in a plane of the first glazing pane. A mounting hinge defines a hinge axis and is secured to the insulated glazing for hingedly mounting the insulated glazing for awning-type movement about the hinge axis. A window regulator is secured to the insulated glazing for controlling the awning-type movement of the insulated glazing about the hinge axis.

34 Claims, 5 Drawing Sheets

AWNING-TYPE INSULATED GLAZING ASSEMBLY

FIELD OF THE INVENTION

This invention relates to insulated glazing assemblies, and, more particularly, to insulated glazing assemblies for vehicles having awning-type opening and closing movement.

BACKGROUND OF THE INVENTION

Passenger vehicles such as busses, recreational vehicles, rail cars, and the like typically have windows, including both fixed and opening windows. Certain windows on such vehicles, e.g., emergency egress windows, open freely about a hinge once unlatched, but cannot be opened and closed in a controlled manner. The frame for some known vehicle windows is exposed around the periphery of the window, detracting from the aesthetic appearance of the window. It is desirable to have a window design that permits the window to be opened and closed in a controlled manner with an awning-like movement, has an insulated glazing, and permits at least a portion of the frame of the window to be hidden behind the glazing pane.

It is an object of the present invention to provide a glazing assembly that reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

In accordance with a first aspect, an awning-type insulated glazing assembly includes an insulated glazing having a first glazing pane and a second glazing pane mounted parallel to and spaced from the first glazing pane. The first glazing pane has a marginal portion that extends beyond the second glazing pane in at least a first direction in a plane of the first glazing pane. A mounting hinge defines a hinge axis and is secured to the insulated glazing for hingedly mounting the insulated glazing for awning-type movement about the hinge axis between an open position and a closed position. A window regulator is secured to the insulated glazing for controlling the awning-type movement of the insulated glazing about the hinge axis.

In accordance with a second aspect, an awning-type insulated glazing assembly for installation in a vehicle window opening includes a first insulated glazing unit having a first glazing pane and a second glazing pane mounted parallel to and spaced from the first glazing pane. Mounting bracketry includes a mounting hinge defining a hinge axis, the mounting bracketry being secured to the first insulated glazing unit for hingedly mounting the first insulated glazing unit for awning-type movement in the window opening about the hinge axis between an open position and a closed position. The first glazing pane has a marginal portion that extends beyond the second glazing pane in at least a first direction in a plane of the first glazing pane. A window regulator is secured to the first insulated glazing unit for controlling the awning-type movement of the first insulated glazing unit. A panel is secured to the mounting bracketry substantially coplanar with the closed position of the first insulated glazing unit.

In accordance with yet another aspect, an awning-type insulated glazing assembly for installation in a vehicle window opening includes a first insulated glazing unit including a first glazing pane and a second glazing pane mounted parallel to and spaced from the first glazing pane. A spacer is positioned between the first glazing pane and the second glazing pane. A second insulated glazing unit includes a third glazing pane and a fourth glazing pane mounted parallel to and spaced from the third glazing pane. A spacer is positioned between the third glazing pane and the fourth glazing pane. Mounting bracketry includes a mounting hinge defining a hinge axis, the mounting bracketry being secured to the first insulated glazing unit for hingedly mounting the first insulated glazing unit for awning-type movement in the window opening about the hinge axis between an open position and a closed position. The mounting bracketry is secured to the second insulated glazing unit for mounting the second insulated glazing unit substantially coplanar with the closed position of the first insulated glazing unit. The first glazing pane has a marginal portion that extends beyond the second glazing pane in at least a first direction in a plane of the first glazing pane and the third glazing pane has a marginal portion that extends beyond the fourth glazing pane in at least a first direction in a plane of the third glazing pane. A window regulator is secured to the first insulated glazing unit for controlling the awning-type movement of the first insulated glazing unit.

Substantial advantage is achieved by providing awning-type insulated glazing assemblies. In particular, such glazing assemblies provide for controlled opening movement of insulated glazing assemblies, which is desirable for ventilation of vehicles.

These and additional features and advantages of the invention disclosed here will be further understood from the following detailed disclosure of certain preferred embodiments.

Figure 1:
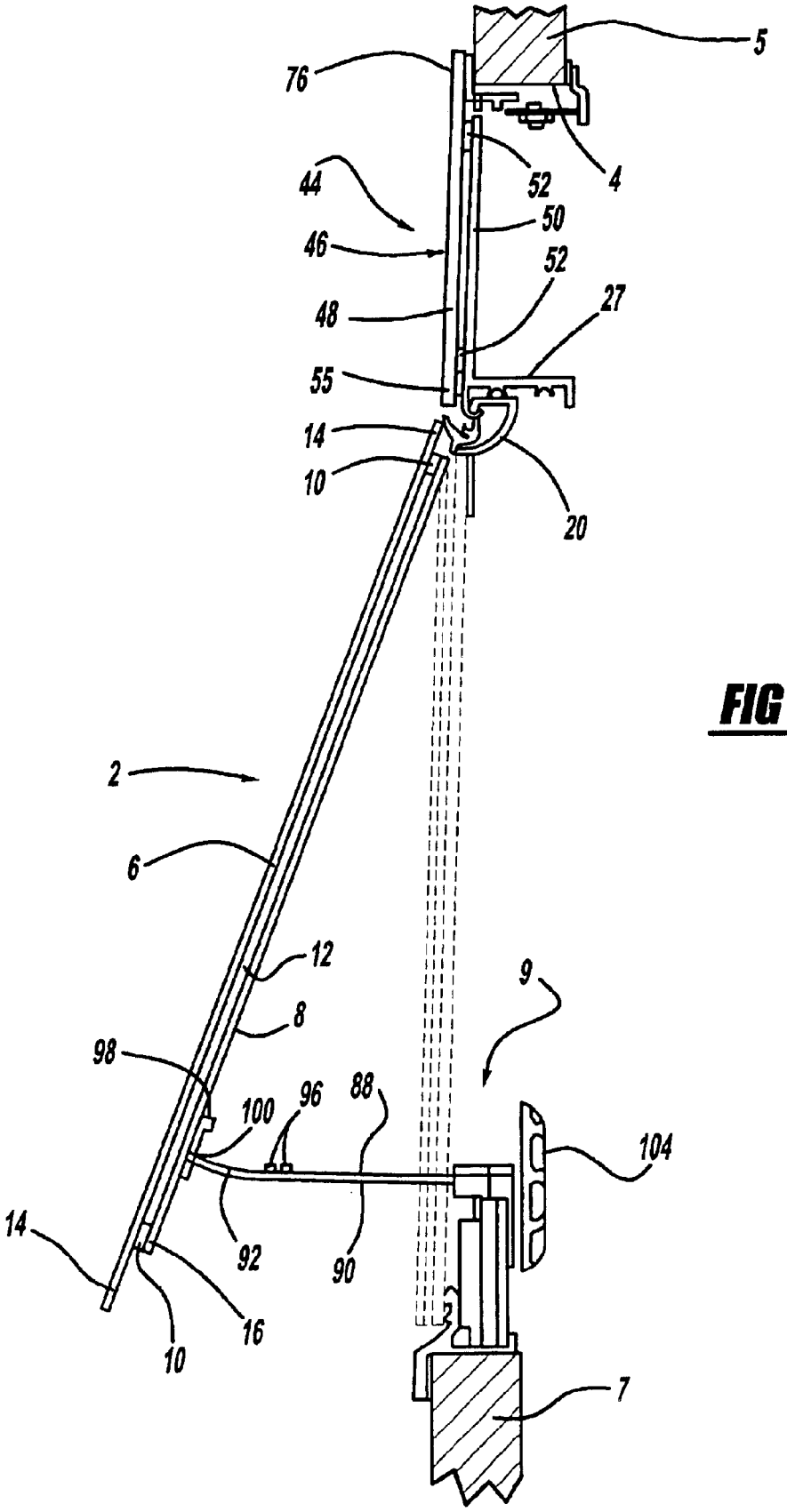
FIG. 1 is a section view, shown partially broken away, of an awning-type insulated glazing assembly in accordance with a preferred embodiment of the present invention, shown installed in a vehicle window opening.

The figures referred to above are not drawn necessarily to scale and should be understood to present a representation of the invention, illustrative of the principles involved. Some features of the awning-type insulated glazing assembly depicted in the drawings have been enlarged or distorted relative to others to facilitate explanation and understanding. The same reference numbers are used in the drawings for similar or identical components and features shown in various alternative embodiments. Awning-type insulated glazing assemblies as disclosed herein, will have configurations and components determined, in part, by the intended application and environment in which they are used.

DETAILED DESCRIPTION OF CERTAIN PREFERRED EMBODIMENTS

It will be understood by those skilled in the art that the window assemblies disclosed and described herein are suitable for use in numerous applications, including for example, mass transit vehicles such as busses, or rail or subway cars. For purposes of illustration, various preferred and alternative features and aspects of the invention are now described in the context of rectangular windows.

In certain preferred embodiments, window assemblies in accordance with the present invention are flush mountable, that is, the window assembly is mounted such that the exterior surface of the window glazing is substantially flush with the exterior surface of the vehicle. Additionally, the frame of the window may be a hidden frame, that is, the frame is substantially not visible from the exterior of the vehicle save for that portion that might be visible through the window glazing. The window assembly is typically installed in a window opening defined by a body of a vehicle, such as a bus. The vehicle body portions that define a rectangular window opening typically comprise a window opening header, a window opening footer, and two window opening jambs, as described below.

As seen in FIG. 1, an insulated glazing assembly 2 is positioned within a window opening 4 defined by a header 5, a footer 7, and side jambs (not shown) of a vehicle. Glazing assembly 2 is shown here in solid lines in its open position, and in dashed lines its closed position. Glazing assembly 2 pivots outwardly about its upper edge with an awning-type movement, which is controlled by window regulator 9, as further described below. Insulated glazing assembly 2 includes a first, or outer, glazing pane 6. A second, or inner, glazing pane 8 is spaced inwardly of first glazing pane 6. Directional terms used herein refer to directions with respect to the vehicle within which glazing assembly 2 is positioned. Thus, inwardly refers to a direction extending from the exterior toward the interior of the vehicle, while outwardly refers to a direction extending from the interior toward the exterior of the vehicle. Upwardly refers to a vertical direction extending toward a top of the vehicle, while downwardly refers to a vertical direction extending toward a bottom of the vehicle.

A spacer 10 is positioned between first glazing pane 6 and second glazing pane 8 proximate a peripheral edge of second glazing pane 8, creating an air gap 12 between the glazing panes. Air gap 12 provides an insulative capability for glazing assembly 2. Spacer 10 may be formed of aluminum, plastic, or any other suitable material that will become readily apparent to those skilled in the art, given the benefit of this disclosure. In certain preferred embodiments, first glazing pane 6 is at least approximately ⅛ inches thick, second glazing pane 8 is at least approximately ⅛ inches thick, and air gap 12 has a thickness of at least approximately 3/16 inches.

In certain preferred embodiments, at least a portion of first glazing pane 6 has a marginal portion 14 that extends beyond a peripheral edge 16 of second glazing pane 8 in a direction of the plane defined by first glazing pane 6. In the embodiment illustrated in FIG. 1, the entire periphery of first glazing pane 6 has marginal portion 14 extending beyond peripheral edge 16 of second glazing pane 8. In such an embodiment, glazing assembly 2 appears to be frameless, since any mounting bracketry, or frame, to which glazing assembly 2 is secured is hidden behind glazing assembly 2. Such a construction, which appears to be frameless, results in improved aesthetics for the vehicle.

Figure 2:
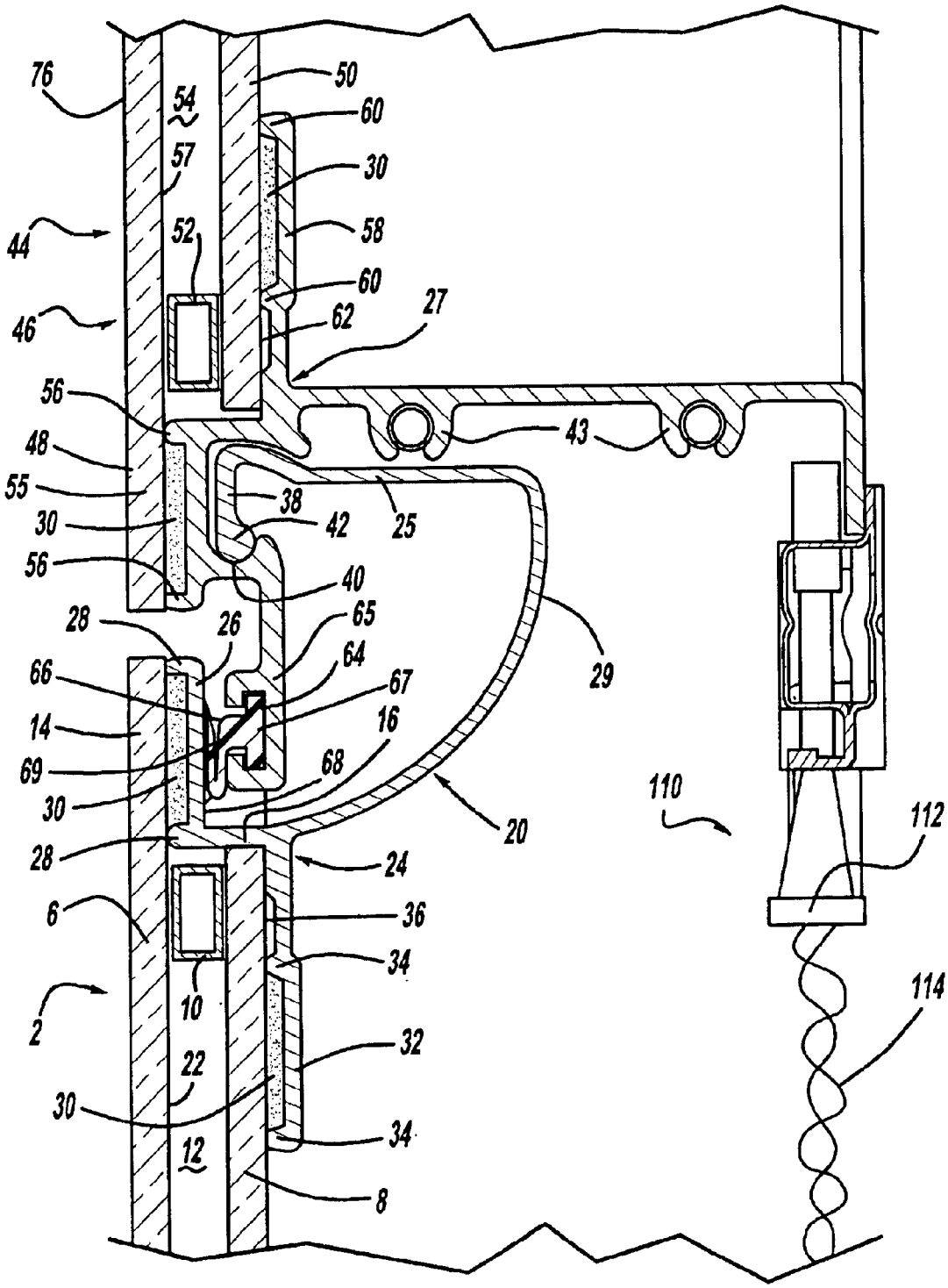
FIG. 2 is an enlarged section view of the mounting hinge of the awning-type insulated glazing assembly of FIG. 1.
Figure 4:
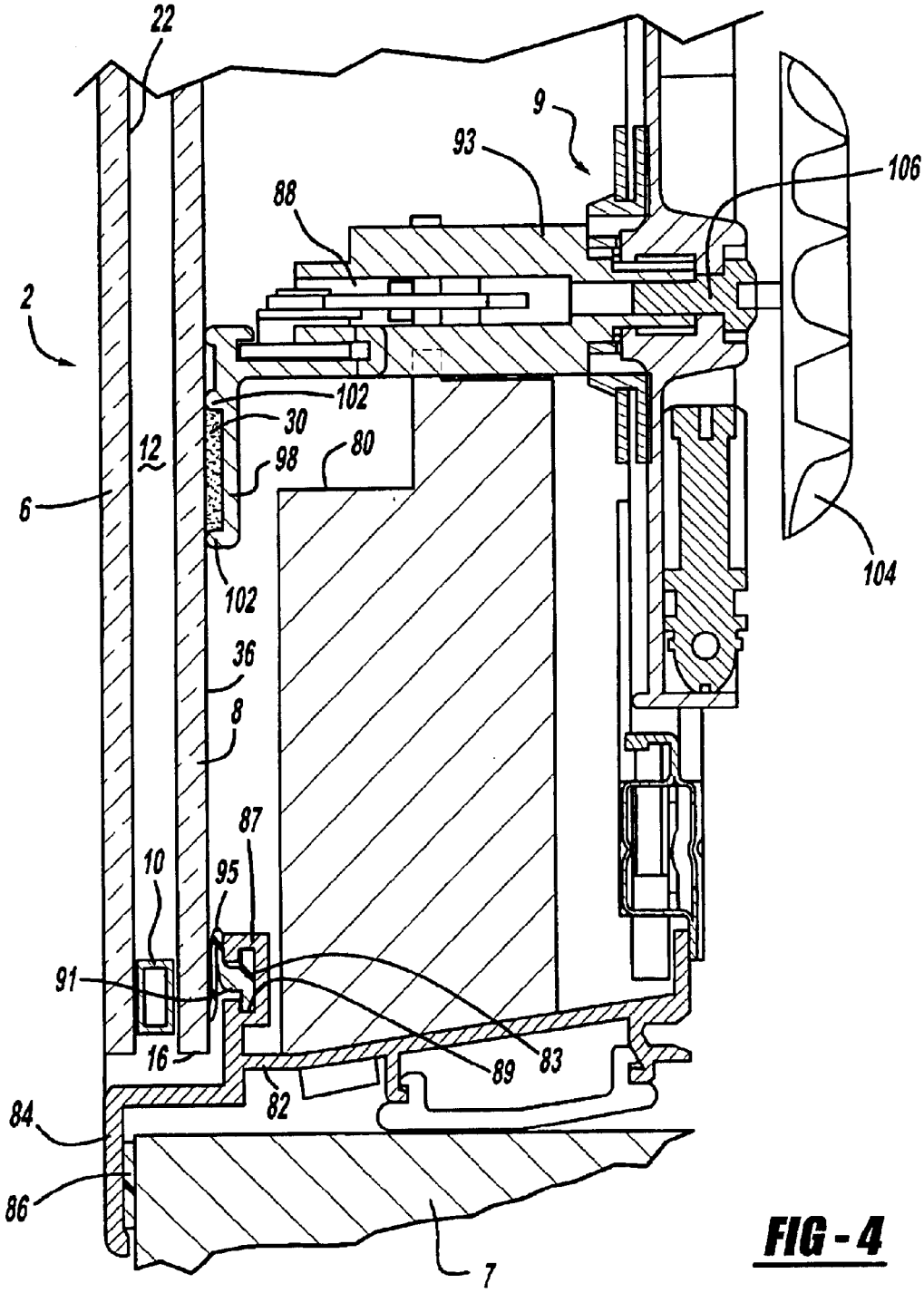
FIG. 4 is an enlarged section view of the lower edge area of the awning-type insulated glazing assembly of FIG. 1, showing the window regulator that controls movement of the glazing assembly.

It is to be appreciated that in certain preferred embodiments, only a portion of first glazing pane 6 has marginal portion 14 extending beyond peripheral edge 16 of second glazing pane 8. For example, in certain preferred embodiments, only the upper edge of first glazing pane 6 has marginal portion 14 extending beyond peripheral edge 16 of second glazing pane 8, as seen in FIG. 2, while the remaining edges of first glazing pane 6 extends only to the same extent as, and not beyond, peripheral edge 16 of second glazing pane 8, as seen in FIG. 4. In this embodiment, marginal portion 14 obscures from view a portion of the mounting bracketry for glazing assembly 2.

As seen in FIG. 2, the mounting bracketry includes a mounting hinge 20 positioned proximate an upper edge of glazing assembly 2, and which defines a hinge axis about which glazing assembly 2 is pivoted as it opens and closes. In a preferred embodiment, mounting hinge 20 is formed of a first portion 24 that is secured to glazing assembly 2 and a second portion 27 that is pivotally engaged by first portion 24. First portion 24 has a horizontally extending pivot portion 25. A connecting portion 29 extends between a lower portion of first portion 24 and pivot portion 25. In certain embodiments, connecting portion 29 is a curved member, curving inwardly and upwardly from a lower portion of first portion 24 to pivot portion 25. In the illustrated embodiment, first portion 24 has a first flange 26 extending upwardly and substantially parallel to first glazing pane 6. A pair of lips 28 extends outwardly from flange 26, substantially perpendicular to flange 26. Adhesive 30 is captured between lips 28, and secures flange 26 to interior surface 22 of first glazing pane 6. A second flange 32 of first portion 24 is positioned slightly inwardly of first flange 26 and extends downwardly and substantially parallel to second glazing pane 8. A pair of lips 34 extends outwardly from flange 32, substantially perpendicular to flange 32. Adhesive 30 is captured between lips 34, and secures flange 32 to an interior surface 36 of second glazing pane 8.

In the embodiment illustrated in FIG. 2, pivot portion 25 of mounting hinge 20 includes a downwardly extending extension portion 38. Extension portion 38 is received in a trough 40 of second portion 27. The engagement of extension portion 38 within trough 40 provides a pivotal engagement between mounting hinge 20 and second portion 27, allowing glazing pane 2 to swing outwardly from the vehicle, as seen in FIG. 1. In a preferred embodiment, an end 42 of extension portion 38 has a substantially circular cross-section, enhancing the pivoting capability of extension portion 38 within trough 40. Second portion 27 has a pair of brackets 43 that receive fasteners such as screws (not shown) in order to secure second portion 27 to the side jambs of the vehicle.

In certain preferred embodiments, as illustrated in FIGS. 1–2, a panel 44 is positioned above glazing assembly 2. In the illustrated embodiment, panel 44 is formed of a second insulated glazing assembly 46, having a first, or outer glazing pane 48 and a second, or inner, glazing pane 50 spaced from first glazing pane 48 by a spacer 52 to form an air gap 54. The exterior surface of first glazing pane 48 is preferably substantially flush with the exterior surface of first glazing pane 6. In the illustrated embodiment, a least a portion of first glazing pane 48 has a marginal portion 55 extending beyond the peripheral edge of second glazing pane 50. As with glazing assembly 2, it is to be appreciated that all of first glazing pane 48 may have such a marginal portion 55 extending beyond the peripheral edge of second glazing pane 50, or only a portion thereof may have such a marginal portion. It is also to be appreciated that in other preferred embodiments, panel 44 is not an insulated glazing assembly, and may be formed of any other desired material, including, e.g., aluminum or stainless steel.

Second portion 27 has a pair of lips 56 extending outwardly, between which adhesive 30 is captured to secure second portion 27 to an interior surface 57 of first glazing pane 48. A flange 58 extends upwardly from second portion 27, substantially parallel to second glazing pane 50. A pair of lips 60 extends outwardly from flange 58, substantially perpendicular to flange 58. Adhesive 30 is captured between lips 60, and secures flange 58 to an interior surface 62 of second glazing pane 50.

A flange 65 of second portion 27 is positioned inwardly of flange 26 of mounting hinge 20 and extends downwardly from second portion 27 below trough 40. Flange 65 has a T-shaped channel 64 that opens outwardly toward flange 26. A seal 66 is received in channel 64 and engages an interior surface 68 of flange 26 when glazing assembly 2 is in its closed position. Seal 66 has a first portion 67 with a T-shaped cross-section configured to mate with T-shaped channel 64, and a second portion 69 that has a V-shaped cross section when in its free state. When glazing assembly 2 is in its closed position, second portion 69 of seal 66 is compressed between flange 26 of mounting hinge 20 and flange 65 of second portion 27, thereby providing a weatherproof seal. Seal 66 is preferably formed of an elastomeric material, such as natural or synthetic rubber, ethylene-propylene terpolymer (EPDM), vinyl, polyvinyl chloride, thermoplastic elastomer, or a closed-cell foam material. Other suitable materials for seal 66 will become readily apparent to those skilled in the art, given the benefit of this disclosure.

In certain preferred embodiments, as seen in FIG. 2, a screen assembly 110 is positioned inwardly of glazing assembly 2. Screen assembly 110 is formed of a frame 112 and a mesh portion 114 secured about its edges to frame 112. Frame 112 is secured at its upper edge to first portion 27 of mounting hinge 20, and its lower and side edges (not shown) to suitable frame members that secure screen assembly 110 to the vehicle. Screen assembly 110 allows ventilation when glazing assembly 2 is in its open position, while providing protection for the interior of the vehicle from flying insects.

Figure 3:
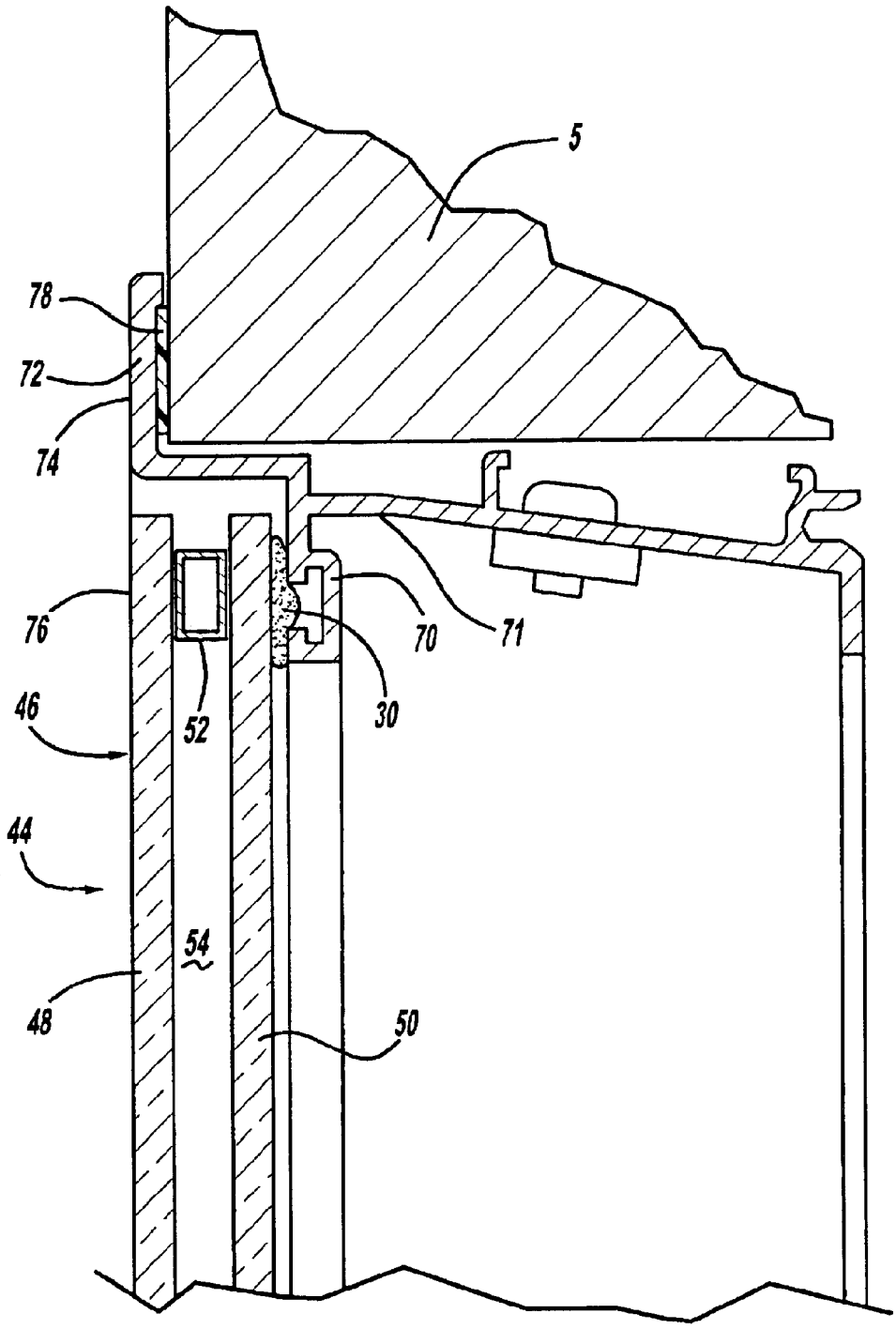
FIG. 3 is an enlarged section view of the upper edge area of the awning-type insulated glazing assembly of FIG. 1.

As seen in FIG. 3, an upper portion of panel 44 is secured by way of adhesive 30 to a downwardly extending first flange 70 of a frame member 71. A second flange 72 is position outwardly of first flange 70, and extends upwardly from frame member 71. An outer surface 74 of flange 72 is substantially flush with an outer surface 76 of first glazing pane 48. A seal 78 is positioned between flange 72 and header 5 of the vehicle, thereby providing a weatherproof seal. Seal 78 is preferably formed of an elastomeric material, such as natural or synthetic rubber, ethylene-propylene terpolymer (EPDM), vinyl, polyvinyl chloride, thermoplastic elastomer, or a closed-cell foam material. Other suitable materials for seal 78 will become readily apparent to those skilled in the art, given the benefit of this disclosure.

Figure 5:
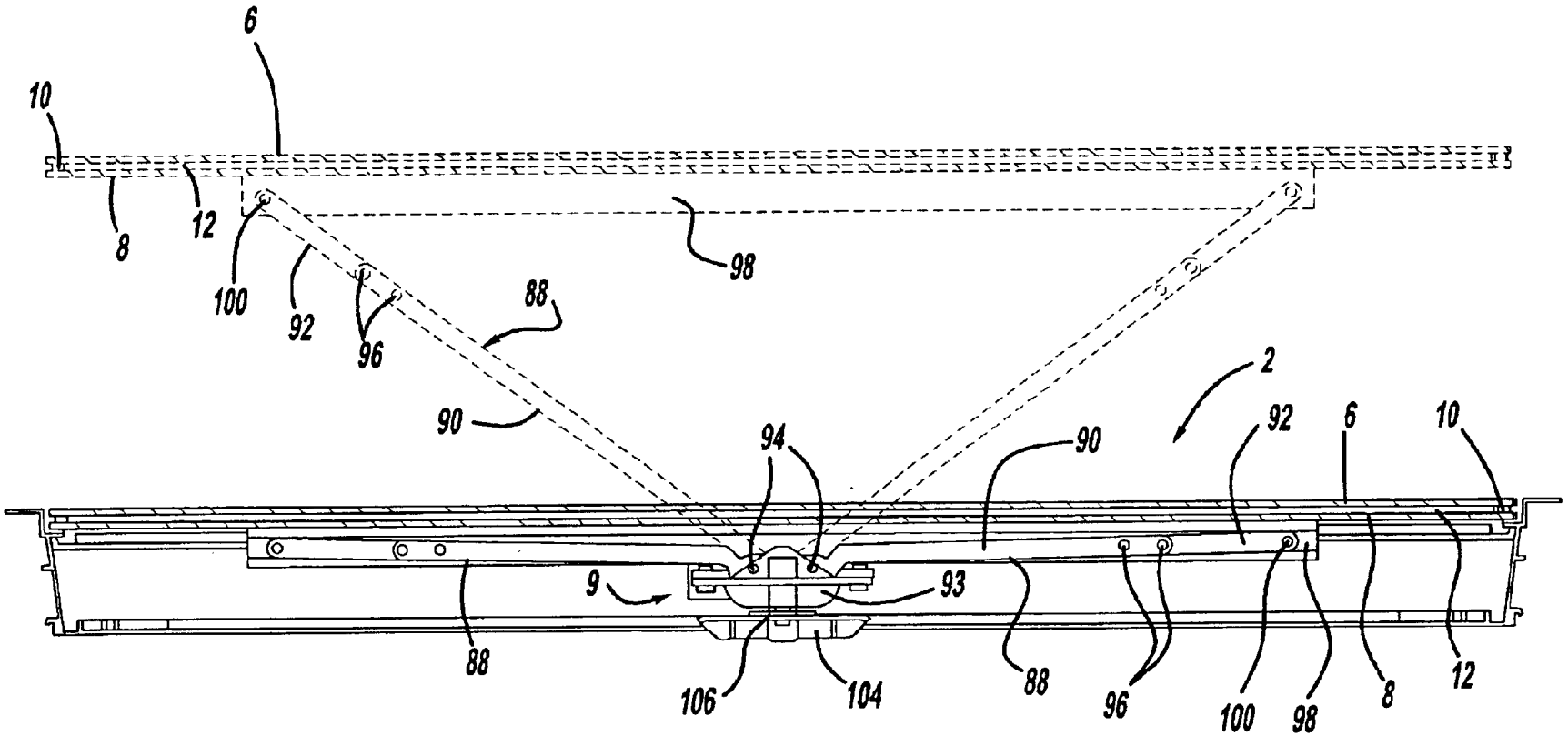
FIG. 5 is a plan view of the awning type insulated glazing assembly of FIG. 1, shown in its open and closed positions.

Window regulator 9 is shown in greater detail in FIGS. 4–5, which is a view from above, showing glazing assembly 2 in its open position in dashed lines and in its closed position in solid lines. In the illustrated embodiment, window regulator 9 is a cross-arm window regulator having arms that extend outwardly in scissors-like fashion to control the opening and closing of glazing assembly 2. Window regulator 9 has a base portion 80 that is secured to a frame member 82 of the vehicle. A first flange 84 of frame member 82 extends downwardly along an outside surface of footer 7. A seal 86 is positioned between flange 84 and footer 7 of the vehicle, thereby providing a weatherproof seal. Seal 86 is preferably formed of an elastomeric material, such as natural or synthetic rubber, ethylene-propylene terpolymer (EPDM), vinyl, polyvinyl chloride, thermoplastic elastomer, or a closed-cell foam material. Other suitable materials for seal 86 will become readily apparent to those skilled in the art, given the benefit of this disclosure.

A second flange 87 of frame member 82 is positioned inwardly of first flange 84 and extends upwardly from frame member 82. Flange 87 has a T-shaped channel 89 that opens outwardly toward glazing assembly 2. A seal 91 is received in channel 89 and engages interior surface 36 of second glazing pane 8 when glazing assembly 2 is in its closed position. Seal 91 has a first portion 83 with a T-shaped cross-section configured to mate with T-shaped channel 89, and a second portion 95 that has an inverted V-shaped cross section when in its free state. When glazing assembly 2 is in its closed position, second portion 95 of seal 91 is compressed between flange 87 and second glazing pane 8, thereby providing a weatherproof seal. Seal 91 is preferably formed of an elastomeric material, such as natural or synthetic rubber, ethylene-propylene terpolymer (EPDM), vinyl, polyvinyl chloride, thermoplastic elastomer, or a closed-cell foam material. Other suitable materials for seal 91 will become readily apparent to those skilled in the art, given the benefit of this disclosure.

A pair of arms 88 connect window regulator 9 to glazing assembly 2. Each arm 88 is formed of a first portion 90 and a second portion 92. First portion 90 is pivotally connected at a first end to a central portion 93 of window regulator 9 by a pin 94. A second end of first portion 90 is pivotally connected to a first end of second portion 92 by a pair of pins 96. A second end of second portion 92 is pivotally connected to a mounting member 98 by way of a pin 100. A pair of lips 102 extends outwardly and substantially perpendicular to mounting member 98. Adhesive 30 is captured between lips 102, and secures mounting member 98 to interior surface 36 of second glazing pane 8.

A handle 104 of window regulator 9 is connected by a linkage 106 to arms 88. In operation, as handle 104 is rotated in one direction, linkage 106 causes arms 88 to extend in scissors-like fashion. As arms 88 extend, glazing assembly 2 pivots outwardly about mounting hinge 20 (as seen in FIG. 1), that is, about its upper edge, thereby opening glazing assembly 2 with an awning-type movement. To close glazing assembly 2, handle 104 is simply rotated in the opposite direction, causing arms 88 to retract. Thus, glazing assembly 2 can be opened in a controlled manner a desired amount. In certain preferred embodiments, glazing assembly 2 opens to an angle of approximately 30–45°, although it is to be appreciated that glazing assembly 2 may open a greater or lesser amount.

In certain preferred embodiments, second portions 92 are formed of a flexible material, e.g., stainless steel, spring steel, allowing second portions 92 to flex upwardly as glazing assembly 2 is opened and the lower edge of glazing assembly 2 travels outwardly and upwardly.

It is to be appreciated that other types of window regulators suitable for controlling the operation glazing assembly 2 for awning-type movement about its hinged upper edge are considered to be within the scope of the invention. Exemplary suitable window regulators include torque tube type and power versions. Other suitable window regulators will become readily apparent to those skilled in the art, given the benefit of this disclosure.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. An awning-type insulated glazing assembly comprising, in combination:

an insulated glazing comprising a first glazing pane and a second glazing pane mounted parallel to and spaced from the first glazing pane, the first glazing pane having a marginal portion extending beyond the second glazing pane in at least a first direction in a plane of the first glazing pane;

mounting bracketry comprising a mounting hinge defining a hinge axis and secured to the insulated glazing for hingedly mounting the insulated glazing for awning-type movement about the hinge axis between an open position and a closed position; and a window regulator secured to the insulated glazing for controlling the awning-type movement of the insulated glazing about the hinge axis;

wherein the mounting bracketry is entirely interior of the first glazing pane.

2. The awning-type insulated glazing assembly of claim 1, wherein the mounting hinge comprises a first portion secured to the insulated glazing and a second portion pivotally engaged by the first portion.

3. The awning-type insulated glazing assembly of claim 2, wherein the second portion includes a trough and the first portion includes an extension portion received in the trough.

4. The awning-type insulated glazing assembly of claim 3, wherein an end of the extension portion has a substantially circular cross-section.

5. The awning-type insulated glazing assembly of claim 2, further comprising a second insulated glazing unit comprising a third glazing pane and a fourth glazing pane mounted parallel to and spaced from the third glazing pane, the second insulated glazing unit being secured to the second portion of the mounting hinge such that the second insulated glazing unit is substantially coplanar with the closed position of the first glazing pane.

6. The awning-type insulated glazing assembly of claim 5, wherein the third glazing pane has a marginal portion extending beyond the fourth glazing pane in at least a first direction in a plane of the third glazing pane.

7. The awning-type insulated glazing assembly of claim 6, wherein the second portion of the mounting hinge is secured to the marginal portion of the third glazing pane.

8. The awning-type insulated glazing assembly of claim 1, further comprising a screen assembly secured to the mounting hinge and positioned inwardly of the insulated glazing.

9. The awning-type insulated glazing assembly of claim 1, wherein the window regulator comprises a cross-arm window regulator.

10. The awning-type insulated glazing assembly of claim 9, wherein the window regulator includes a handle, and a pair of arms, each arm connected at one end to the insulated glazing and at an opposite end to a linkage that is operably connected to the handle.

11. The awning-type insulated glazing assembly of claim 10, wherein each arm comprises a first portion and a second portion, the first portion connected at a first end to the linkage and at a second end to a first end of the second portion, a second end of the second portion being connected to the insulated glazing.

12. The awning-type insulated glazing assembly of claim 10, wherein at least a portion of each arm is configured to flex to accommodate the awning-type movement of the insulated glazing about the hinge axis.

13. The awning-type insulated glazing assembly of claim 1, wherein the mounting hinge does not contact an upper peripheral edge of the first glazing pane.

14. The awning-type insulated glazing assembly of claim 1, wherein an entire periphery of the first glazing pane has a marginal portion extending beyond the peripheral edge of the second glazing pane.

15. The awning-type insulated glazing assembly of claim 1, wherein the window regulator is bonded directly to an interior-facing surface of the second glazing pane.

16. The awning-type insulated glazing assembly of claim 1, wherein a lower peripheral edge of the first glazing pane is not contacted by a mounting member.

17. The awning-type insulated glazing assembly of claim 1, wherein the mounting hinge is bonded to the interior facing surface of the first glazing pane.

18. The awning-type insulated glazing assembly of claim 1, wherein the mounting hinge is bonded to the interior facing surface of the second glazing pane.

19. The awning-type insulated glazing assembly of claim 1, wherein the exterior-facing surface of the first glazing pane is not contacted by the mounting hinge.

20. The awning-type insulated glazing assembly of claim 1, wherein the window regulator does not overlay the exterior-facing surface of the first glazing pane.

21. An awning-type insulated glazing assembly for installation in a vehicle window opening comprising, in combination:

a first insulated glazing unit comprising a first glazing pane and a second glazing pane mounted parallel to and spaced from the first glazing pane;

mounting bracketry comprising a mounting hinge defining a hinge axis, the mounting bracketry being secured to the first insulated glazing unit for hingedly mounting the first insulated glazing unit for awning-type movement in the window opening about the hinge axis between an open position and a closed position, the first glazing pane having a marginal portion extending beyond the second glazing pane in at least a first direction in a plane of the first glazing pane;

a window regulator secured to the first insulated glazing unit for controlling the awning type movement of the first insulated glazing unit; and a panel secured to the mounting bracketry substantially coplanar with the closed position of the first insulated glazing unit, wherein the mounting bracketry is entirely interior of the first glazing pane.

22. The awning-type insulated glazing assembly of claim 21, wherein the panel comprises a second insulated glazing unit comprising a third glazing pane and a fourth glazing pane mounted parallel to and spaced from the third glazing pane, the third glazing pane having a marginal portion extending beyond the fourth glazing pane in at least a first direction in a plane of the third glazing pane.

23. The awning-type insulated glazing assembly of claim 22, wherein the mounting bracketry is secured to the marginal portion of the third glazing pane.

24. The awning-type insulated glazing assembly of claim 21, wherein the mounting hinge comprises a first portion secured to the first insulated glazing unit and a second portion pivotally engaged by the first portion.

25. The awning-type insulated glazing assembly of claim 24, wherein the second portion includes a trough and the first portion includes an extension portion received in the trough.

26. The awning-type insulated glazing assembly of claim 25, wherein an end of the extension portion has a substantially circular cross-section.

27. The awning-type insulated glazing assembly of claim 21, further comprising a screen assembly secured to the mounting bracketry and positioned inwardly of the first insulated glazing unit.

28. The awning-type insulated glazing assembly of claim 21, wherein the window regulator comprises a cross-arm window regulator.

29. The awning-type insulated glazing assembly of claim 28, wherein the window regulator includes a handle, and a pair of arms, each arm connected at one end to the first insulated glazing unit and at an opposite end to a linkage that is operably connected to the handle.

30. The awning-type insulated glazing assembly of claim 29, wherein each arm comprises a first portion and a second portion, the first portion connected at a first end to the linkage and at a second end to a first end of the second portion, a second end of the second portion being connected to the insulated glazing.

31. The awning-type insulated glazing assembly of claim 29, wherein at least a portion of each arm is configured to flex to accommodate the awning-type movement of the insulated glazing about the hinge axis.

32. An awning-type insulated glazing assembly for installation in a vehicle window opening comprising, in combination:

a first insulated glazing unit comprising a first glazing pane and a second glazing pane mounted parallel to and spaced from the first glazing pane;

a spacer positioned between the first glazing pane and the second glazing pane;

a second insulated glazing unit comprising a third glazing pane and a fourth glazing pane mounted parallel to and spaced from the third glazing pane;

a spacer positioned between the third glazing pane and the fourth glazing pane;

mounting bracketry comprising a frame and a mounting hinge defining a hinge axis, the mounting bracketry being secured to the first insulated glazing unit for hingedly mounting the first insulated glazing unit for awning-type movement in the window opening about the hinge axis between an open position and a closed position, and being secured to the second insulated glazing unit for mounting the second insulated glazing unit substantially coplanar with the closed position of the first insulated glazing unit, the first glazing pane having a marginal portion extending beyond the second glazing pane in at least a first direction in a plane of the first glazing pane and the third glazing pane having a marginal portion extending beyond the fourth glazing pane in at least a first direction in a plane of the third glazing pane; and a window regulator secured to the first insulated glazing unit for controlling the awning-type movement of the first insulated glazing unit;

wherein the frame is substantially not visible from an exterior face of the first glazing pane save for that portion that might be visible through the first glazing pane.

33. The awning-type insulated glazing assembly of claim 32, wherein the mounting bracketry does not overlay an exterior-facing surface of the first glazing pane.

34. An awning-type insulated glazing assembly comprising, in combination:

an insulated glazing comprising a first glazing pane and a second glazing pane mounted parallel to and spaced from the first glazing pane, the first glazing pane having a marginal portion extending beyond the second glazing pane in at least a first direction in a plane of the first glazing pane;

a mounting hinge defining a hinge axis and secured to the insulated glazing for hingedly mounting the insulated glazing for awning-type movement about the hinge axis between an open position and a closed position; and a window regulator secured to the insulated glazing for controlling the awning-type movement of the insulated glazing about the hinge axis;

wherein the mounting hinge does not overlay an exterior-facing surface of the first glazing pane; and wherein the first glazing pane has a marginal portion extending beyond the second glazing pane in at least an upward direction in a plane of the first glazing pane to obscure at least a portion of the mounting hinge from being viewed from an exterior of the glazing assembly.

* * * * *